US007285030B1

(12) United States Patent
Houck

(10) Patent No.: US 7,285,030 B1
(45) **Date of Patent: *Oct. 23, 2007**

(54) SWIM FIN

(76) Inventor: Michael Houck, P.O. Box 478, Dubois, WY (US) 82513

( * ) Notice: Subject to any disclaimer, the term of this patent is extended or adjusted under 35 U.S.C. 154(b) by 0 days.

This patent is subject to a terminal disclaimer.

(21) Appl. No.: 11/371,343

(22) Filed: Mar. 8, 2006

(51) Int. Cl.
*A63B 31/12* (2006.01)

(52) U.S. Cl. ..... 441/60

(58) Field of Classification Search ..... 441/59, 441/60, 61, 65
See application file for complete search history.

(56) References Cited

U.S. PATENT DOCUMENTS 7,040,942 B1 * 5/2006 Houck ..... 441/60

* cited by examiner

*Primary Examiner*—Lars A. Olson
(74) *Attorney, Agent, or Firm*—Allen, Dyer, Doppelt, Milbrath & Gilchrist, P.A.

(57) ABSTRACT

A swim fin has at least one fastening member dimensioned to fasten the swim fin onto a user's lower leg between the user's knee and foot. A fin portion is connected to the at least one fastening member and extending laterally outwardly from the fastening member. The connection between the fin portion and the at least one fastening member permits the fin portion to be repositioned upwardly or downwardly relative to the user's lower leg along the at least one fastening member. The present swim fin is equally adaptable for use attached to a swimmer's forearm.

3 Claims, 6 Drawing Sheets

SWIM FIN

FIELD OF THE INVENTION

The present invention relates to the field of swimming and, more particularly, to a swim fin which is not worn on the swimmer's foot, as standard swim fins, but which attaches to a person's lower leg, thus leaving the feet free for walking.

BACKGROUND OF THE INVENTION

Swim fins have been in use for many years by recreational swimmers and divers. The typical swim fin, however, attaches to the swimmer's foot much in the manner of a shoe. Therefore, standard swim fins are generally put on once the swimmer is in the water, if the swimmer is entering from a beach. If the swim fins are put on while the swimmer is on the beach, walking becomes extremely difficult, so much so, that swimmers wearing fins on land will usually walk backwards in and out of the water. Nevertheless, swim fins are popular as they increase the water-pushing power of the swimmer's legs, thereby increasing the swimmer's speed through the water and helping the swimmer stay afloat more easily.

SUMMARY OF THE INVENTION

With the foregoing in mind, the present invention advantageously provides a swim fin which attaches to a swimmer's limbs, especially the lower leg and, alternatively, the forearm, so as to allow the swimmer to put on the swim fins while on land and still be able to walk easily.

In a preferred embodiment, the present swim fin includes a sleeve having a closure effective for fastening the sleeve around a user's lower leg between the user's foot and knee, the sleeve having an upper end to be positioned toward the knee, a lower end to be positioned toward the foot, and an outer surface to be positioned away from the user's leg. A channel is positioned on the outer surface of the sleeve, the channel extending at least partly between the upper end and the lower end of the sleeve. A fin portion is positioned extending away from the sleeve and connected thereto by a flange repositionably engaged with the channel.

In another preferred embodiment, the present swim fin comprises a sleeve dimensioned for securing to a user's limb, the sleeve having an upper end, a lower end, and an outer surface. A first connector is positioned along the outer surface of the sleeve. A fin portion including a plurality of support elements having web material associated therewith, has a second connector repositionably engaged with the first connector so as to be effective in repositioning the fin portion along the outer surface of the sleeve upwardly and downwardly thereon.

Yet another preferred embodiment includes a swim fin comprising at least one fastening member dimensioned to fasten the swim fin onto a user's lower leg between the user's knee and foot and a fin portion connected to the at least one fastening member and extending laterally outwardly from the fastening member. In this embodiment the connection between the fin portion and the at least one fastening member permits the fin portion to be repositioned upwardly or downwardly relative to the user's lower leg along the at least one fastening member. The fastening member may comprise a strap.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

Figure 1:
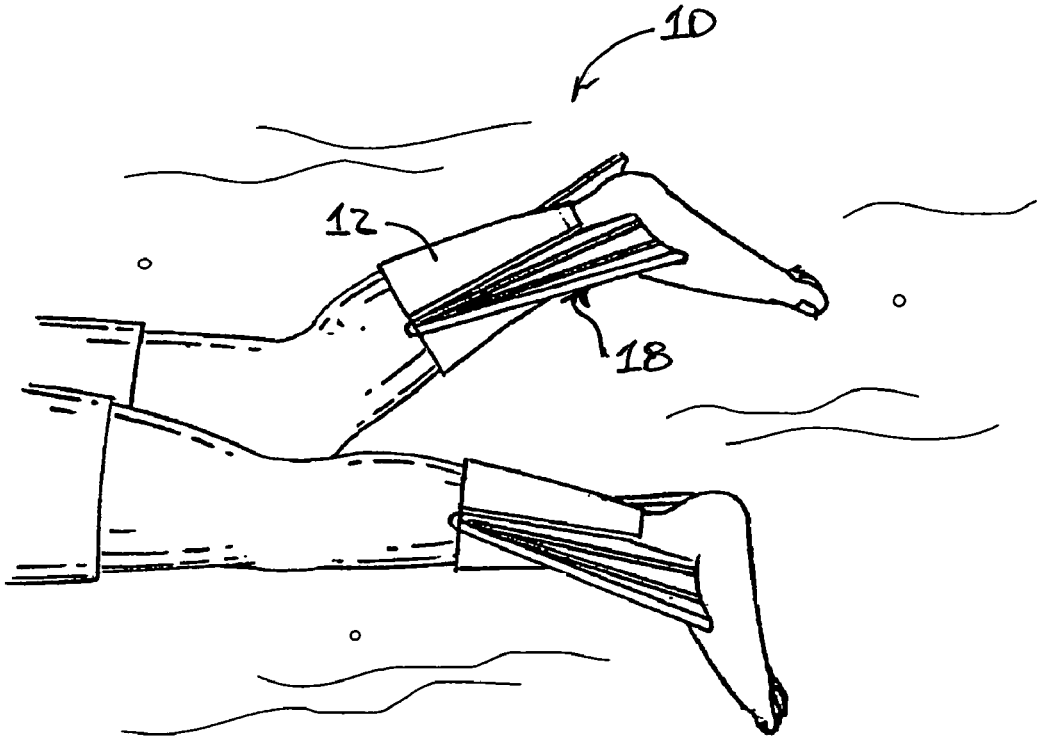
FIG. 1 is a side elevation view illustrating the present swim fins in use by a swimmer.

The present invention will now be described more fully hereinafter with reference to the accompanying drawings, in which preferred embodiments of the invention are shown. Unless otherwise defined, the terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

FIGS. 1-7 illustrate the swim fin 10 disclosed herein. The swim fin 10 comprises a sleeve 12 having a closure 14 effective for fastening the sleeve around a user's lower leg between the user's foot and knee, the sleeve having an upper end to be positioned toward the knee, a lower end to be positioned toward the foot, and an outer surface to be positioned away from the user's leg. A channel 16 is positioned on the outer surface of the sleeve 12, the channel extending at least partly between the upper end and the lower end of the sleeve. A fin portion 18 of the swim fin is positioned extending away from the sleeve 12 and is preferably connected thereto by a flange 20 repositionably engaged in the channel 16.

Figure 3:
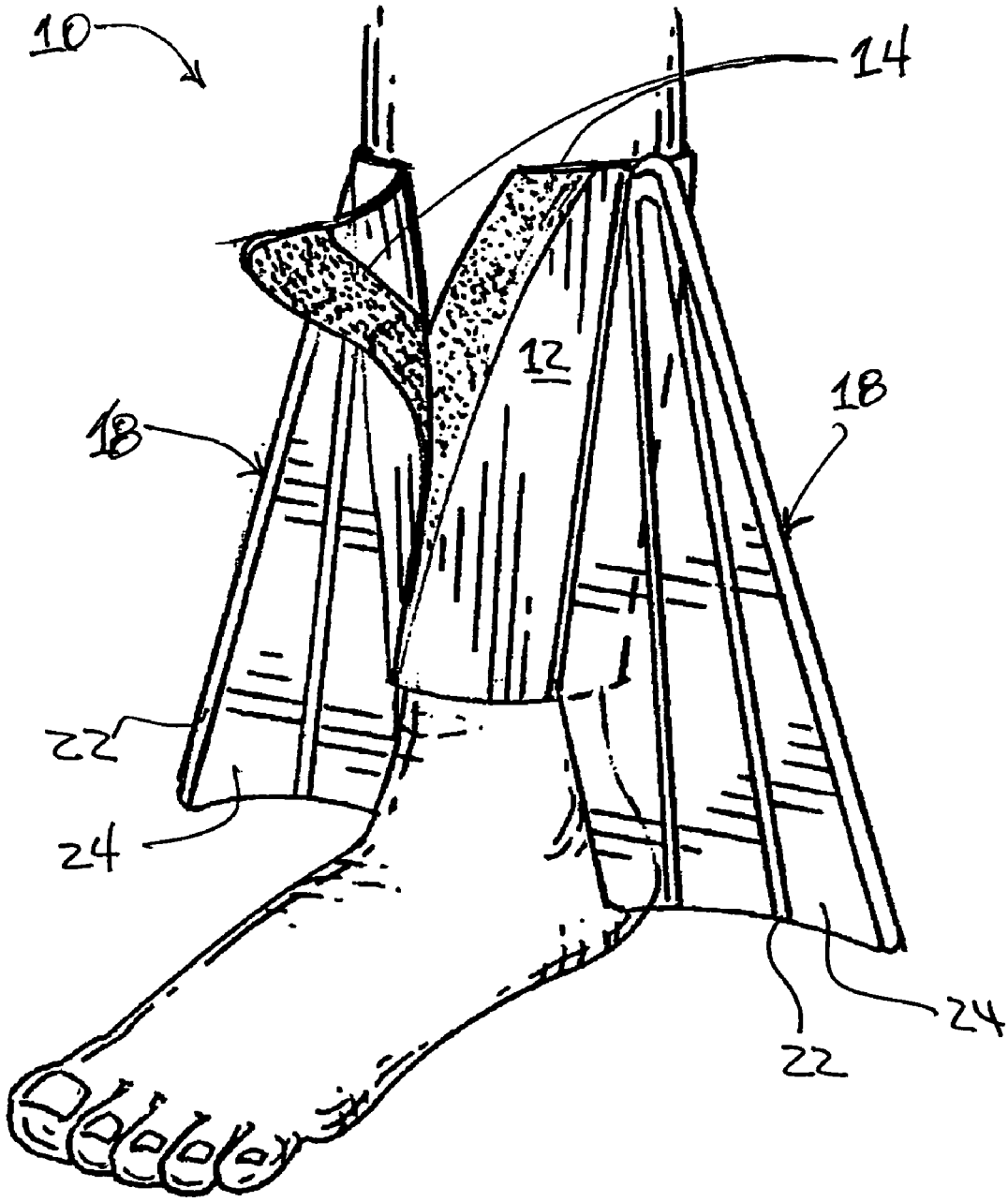
FIG. 3 depicts how an embodiment of the present swim fins is secured to a user's lower leg.
Figure 4:
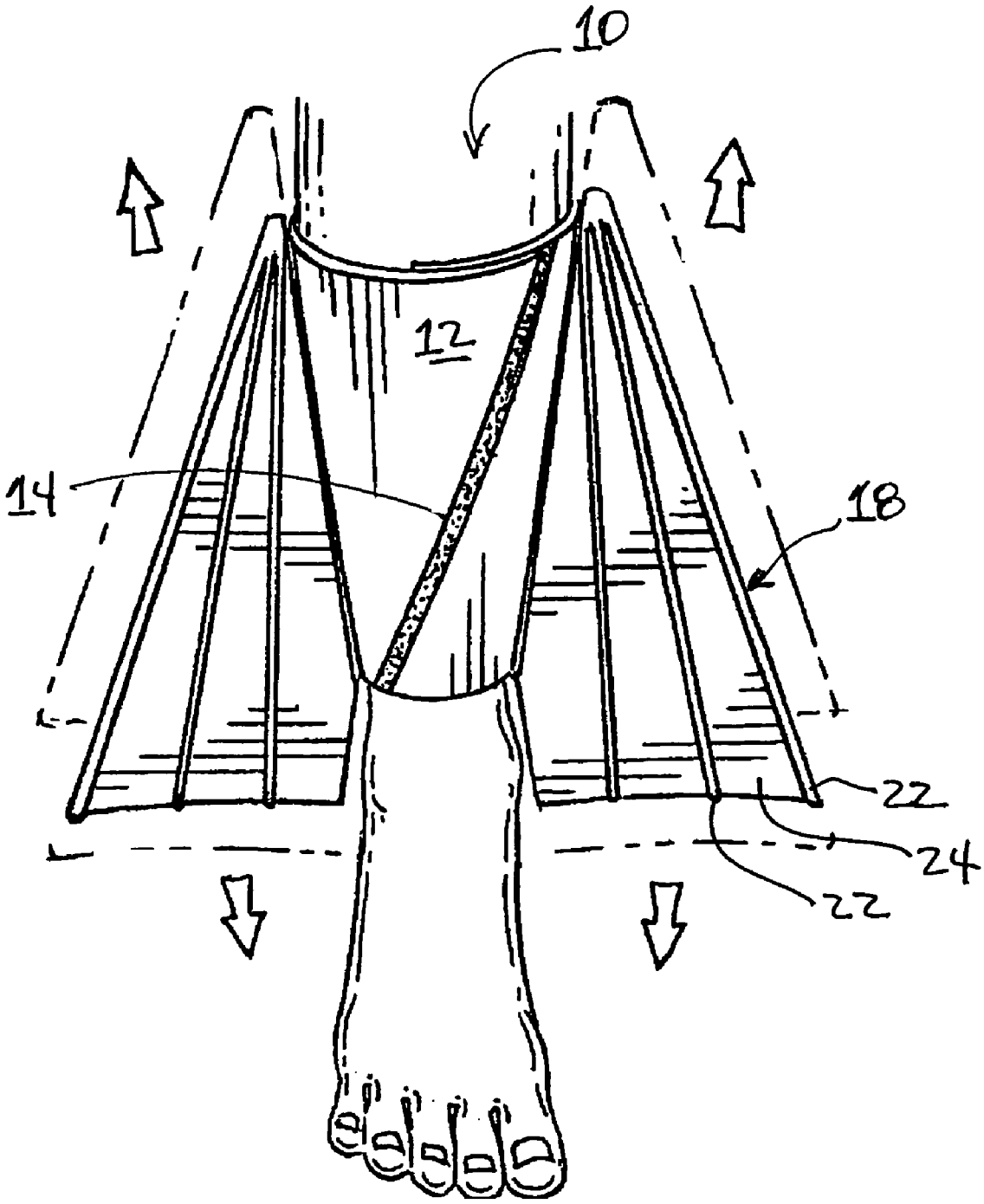
FIG. 4 illustrates the repositionable fin portions of the present invention, which may be moved upwardly or downwardly relative to the sleeve portion.
Figure 5:
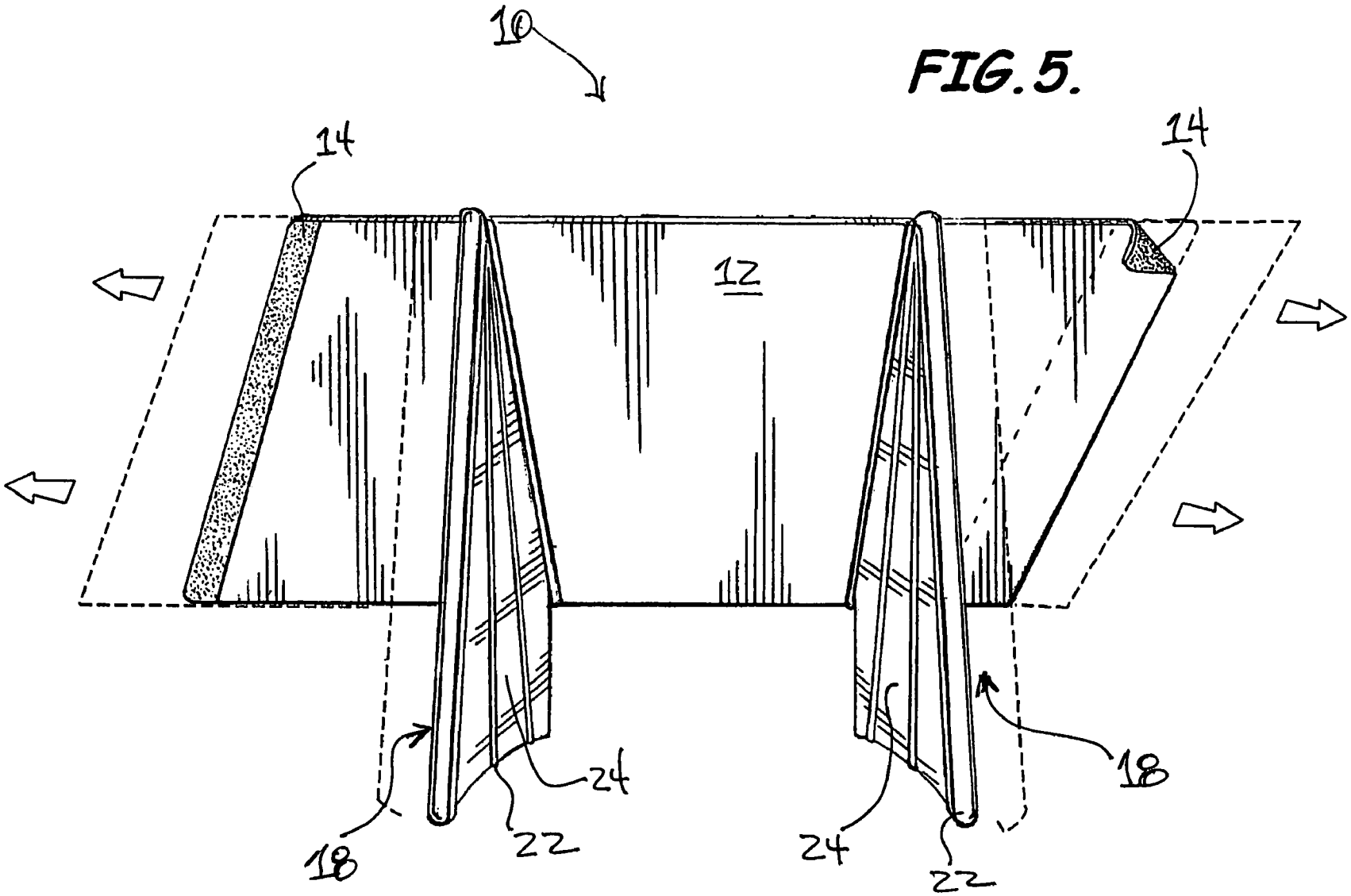
FIG. 5 is a top plan view of the present swim fin in its fully open position.
Figure 6:
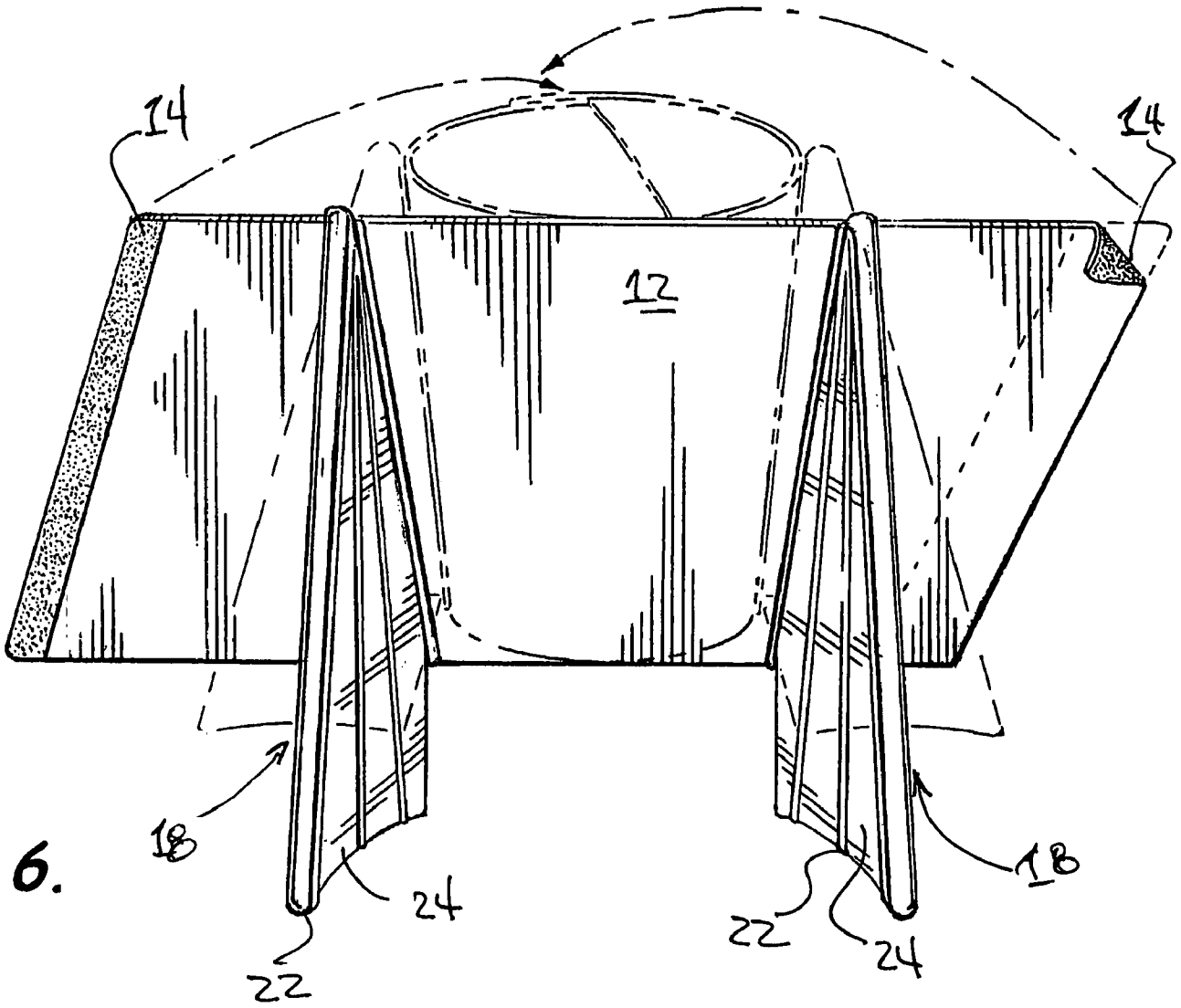
FIG. 6 shows how the swim fin of FIG. 5 wraps around a user's leg or arm in preparation for swimming.
Figure 7:
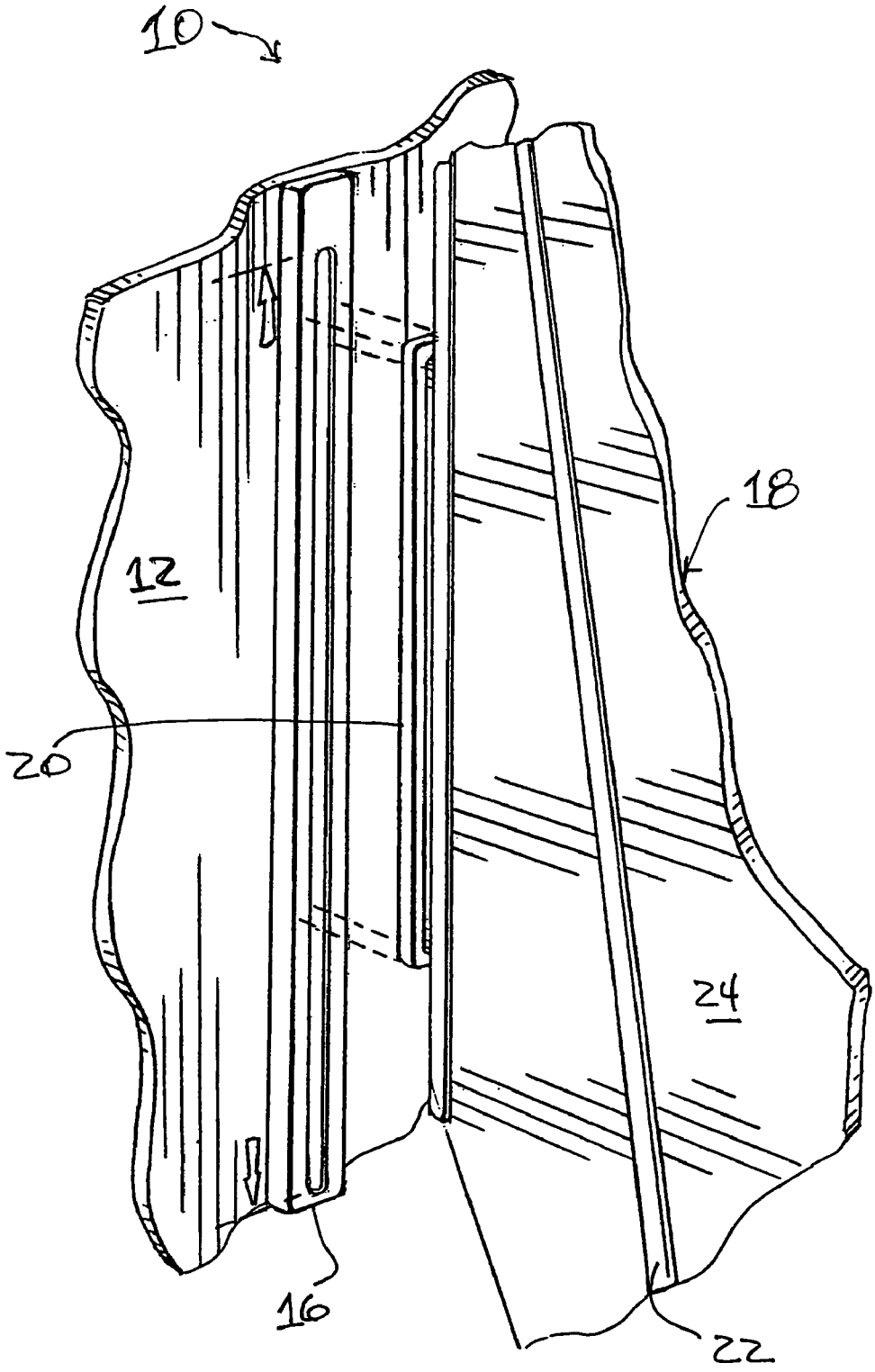
FIG. 7 provides a close-up detail of one embodiment of a connecting mechanism whereby the fin portion is repositionably connected to the sleeve portion.

In the swim fin 10, the repositionably engaged flange 20 allows the fin portion 18 to be moved upwardly and downwardly relative to the sleeve 12, as illustrated in FIGS. 4 and 7. The sleeve 12 may preferably comprise an elastic material and may, particularly, be an elastic sleeve. The sleeve closure 14 may comprise a hook and loop material, as best shown in FIG. 3, for example, the well known Velcro®. The sleeve closure 14 most preferably extends from the upper end to the lower end of the sleeve 12 so that the sleeve may be opened by opening the closure. As seen in FIGS. 3-6, the closure 14 may be biased so that it extends at an angle between a lower end and an upper end of the sleeve 12.

It should be understood that in an alternate embodiment of the present swim fin 10 the sleeve 12 which fits around the user's leg could be manufactured in two parts (not shown) rather than as one entire sleeve. In such an embodiment rather than slipping his/her leg into the sleeve, the user would position the two parts on generally opposite sides of the user's leg and secure them together to form the sleeve around the leg. The two parts of the sleeve may be secured to each other and around the leg by any known closure such as, for example, by Velcro® straps, by snaps, and others.

The channel 16 in which the flange 20 of the fin portion 18 is engaged most preferably extends from the upper end to the lower end of the outer surface of the sleeve 12, as depicted in FIG. 7. The channel 16 most preferably comprises a relatively rigid synthetic material so as to provide sufficient support for engagement of the flange 20 therein. Either the flange 20 on the fin portion 18 or the channel 16, or both, include one or more structural features which aid in physically securing the flange in repositionable engagement with the channel. For example, rather than the flange 20 being a single elongated member, as shown in the figures, it may be a plurality of members which engage in the channel 16. The skilled will readily understand that the concept of the invention includes a fin portion 18 which is repositionably engaged with the sleeve portion 12 by any structural device known and that the described flange and channel arrangement is offered as one example of specific structures which will achieve the desired result.

The fin portion 18 of the swim fin 10 best comprises a relatively resilient synthetic material, so that there is sufficient flexibility in the fin portion to aid the swimming motion. While FIGS. 1-6 illustrate the present swim fin 10 invention as having fin portions 18 extending from generally opposite lateral peripheries of the sleeve 12, it should be understood that in another preferred embodiment of the invention the swim fin includes only one fin portion which extends laterally outwardly from the sleeve and which a user may wear so that the fin portion extends along the outer portion of the user's leg. It should also be recognized that the present swim fin 10 invention allows a user to simultaneously wear standard swim fins which fit onto the user's foot, thereby providing greater propulsion through the water due to the increased surface area of the combination of fins.

Figure 2:
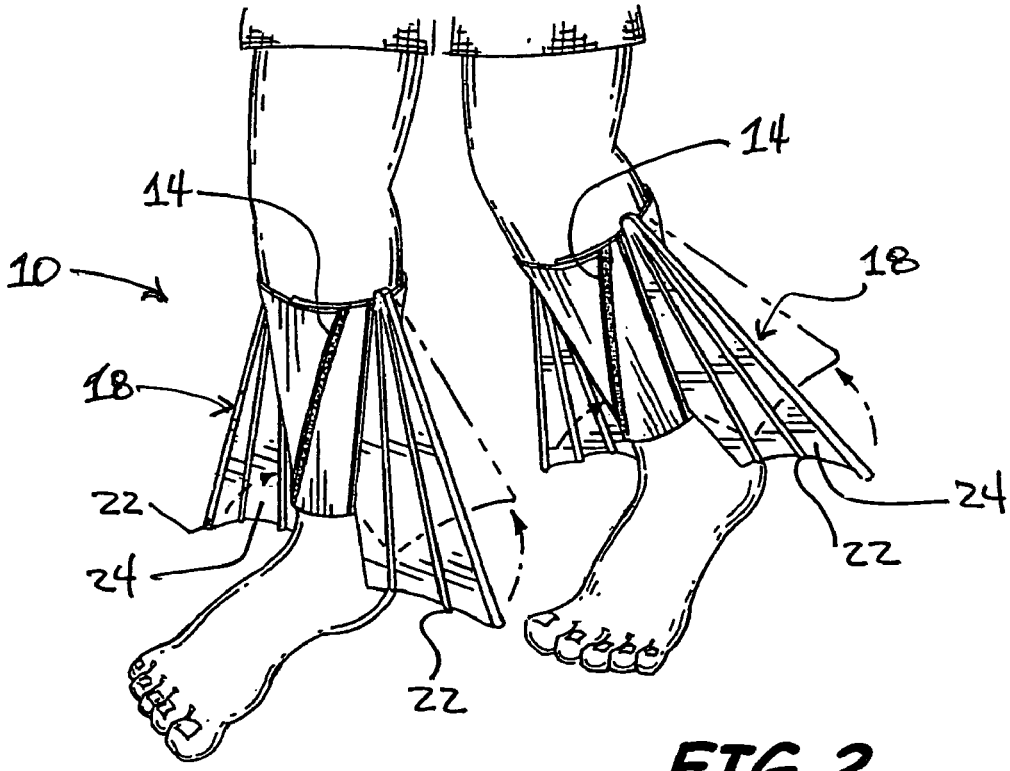
FIG. 2 shows a user walking while wearing the swim fins of FIG. 1 and indicates how the fin portions may be folded back for ease in walking.

The fin portion 18 may be generally shaped as a triangle having an apex positioned toward the upper end of the sleeve and a base toward the lower end of the sleeve, as shown in FIGS. 2-4. The skilled will recognize, however, that fin portion shapes other than approximately triangular are possible and are intended to be included in the present invention. The fin portion 18 preferably includes a plurality of elongated web support members 22 having web material 24 disposed therebetween, as shown in the figures. These elongated support members 22 function as fingers supporting the web material. For example, the support members 22 may have individual sheets of web material disposed therebetween, or the support members may be positioned over or under a continuous sheet of web material. The combination of web material and support members is preferably sufficiently resilient so that the fin portion 18 is foldable, accordion-style, against the sleeve 12. In an embodiment of the invention having two fin portions, the fin portions 18 preferably may be folded toward each other, as indicated in FIG. 2, and held together in this retracted position by any known means, for example, by hook and loop fasteners such as Velcro®.

One structural approach to repositionably engaging the fin portion 18 with the sleeve portion 12 is shown in FIG. 7. A channel 16 is shown positioned along an outer surface of the sleeve portion. The fin portion 18 includes one or more tabs which snap into the channel 16 and which may be slidably repositioned upwardly or downwardly along the channel to vary the position of the fin portion relative to the sleeve, at least within certain limits. The skilled will understand that this arrangement may be reversed, for example, where the tab or tabs are positioned on the sleeve 12 and the channel 16 is positioned on the fin portion 18, preferably along an edge of the fin portion. Other structural arrangements whereby the fin portion may be repositionable relative to the sleeve portion will, no doubt, occur to the skilled. These variations are also intended to be within the scope of the invention, however. For example, ball-ended pins could be provided to snap into a channel or other connector, thereby securing the fin portion to the sleeve.

Moreover, the fin portion 18 could also be repositionably connected to the sleeve 12 by a simple hook and loop fastener such as Velcro®. A hook and loop fastener would render the fin portion 18 easily disconnectable from the sleeve 12 for repositioning relative thereto. Sufficient hook and loop fastener material could be positioned along an outer surface of the sleeve portion 12 to allow the fin portion 18 to be repositionable upwardly, downwardly, forwardly or backwardly relative to the sleeve and the user's leg. This arrangement would allow the user to choose whether to connect one or two fin portions 18 to each sleeve 12. Also, the user could choose to completely disconnect the fin portions 18 for walking or to fold them back against each other while still connected to the sleeve 12 as previously described.

Additionally, even though the present swim fin 10 invention has been primarily described and shown as having the fin portion 18 extending from the sleeve portion 12 at the side of the user's leg, it should be understood that the invention works as well by having the fin portion connected to the sleeve portion at the rear of the user's leg, that is, approximately behind the calf muscle. In this embodiment, the fin portion would most advantageously extend toward the outside in a direction generally tangential to the circumference of the sleeve portion and the user's leg.

In use, the present invention provides an aid to swimming by increasing the amount of water displaced as a swimmer kicks his/her legs. In that regard, those skilled in the art will further recognize that the presently described invention, in any of its embodiments, is easily adapted to be worn secured to a user's forearms for increased propulsion while swimming. As shown in FIG. 3, the user would first secure the present swim fin 10 to a lower portion of the leg. Because the fin portions 18 of the invention are not worn on the foot, the user is easily able to walk in normal fashion while the swim fin 10 is worn. As depicted in FIG. 4 and noted above, the present swim fin 10 may be adjusted upwardly or downwardly relative to the fastening member more specifically identified as the sleeve or elastic sleeve 12. FIG. 5 shows the present swim fin 10 when open, prior to being secured to the user. FIG. 6 shows how the present swim fin 10 would typically be secured around a user's leg by encircling the leg with the sleeve 12. In an alternative embodiment, the sleeve 12 could include a sufficient amount of elastic material so that it would not have to be designed to open or to have a closure. The user would simply insert the foot into the sleeve 12 and pull the sleeve onto the lower leg in the manner of a stocking. In such an embodiment, the sleeve would have to be sufficiently elastic to remain securely positioned on the leg once pulled over the foot. This arrangement would easily apply also to an embodiment of the invention for use on a swimmer's forearms.

Accordingly, in the drawings and specification there have been disclosed typical preferred embodiments of the invention and, although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as recited in the appended claims.

That which is claimed is:

1. A swim fin comprising:

a sleeve having a closure effective for fastening said sleeve around a user's lower leg between the user's foot and knee, said sleeve having an upper end to be positioned toward the knee, a lower end to be positioned toward the foot, and an outer surface to be positioned away from the user's leg;

a channel positioned on the outer surface of said sleeve, said channel extending at least partly between the upper end and the lower end of said sleeve; and a fin portion positioned extending away from said sleeve and connected thereto by a flange repositionably engaged with said channel.

2. The swim fin of claim 1, wherein said repositionably engaged flange allows said fin portion to be moved upwardly and downwardly relative to said sleeve.

3. A swim fin comprising:

a sleeve having at least an elastic portion effective for securing said sleeve around a user's limb, said sleeve having an upper end and a lower end;

a connector extending along at least a portion of an outer surface of said sleeve along a line between the upper and lower ends; and at least one fin portion engaged with said connector so as to be repositionable toward the upper or lower ends of said sleeve.

* * * * *